United States Patent [19]

Ulrich et al.

[11] Patent Number: 4,629,506

[45] Date of Patent: Dec. 16, 1986

[54] PROCESS FOR THE PRODUCTION OF FERROCHROMIUM

[75] Inventors: Klaus Ulrich, Heiligenhaus; Wilhelm Janssen, Muelheim; Dieter Neuschuetz; Thomas Hoster, both of Essen; Hermann Doerr, Muelheim; Dietrich Radke, Ratingen, all of Fed. Rep. of Germany

[73] Assignee: Fried. Krupp Gesellschaft mit beschraenkter Haftung, Essen, Fed. Rep. of Germany

[21] Appl. No.: 684,322

[22] Filed: Dec. 20, 1984

[30] Foreign Application Priority Data

Dec. 31, 1983 [DE] Fed. Rep. of Germany ..... 3347686
Aug. 30, 1984 [DE] Fed. Rep. of Germany ..... 3431854

[51] Int. Cl.[4] ..... C22C 33/00

[52] U.S. Cl. ..... 75/10.63; 420/11; 420/34

[58] Field of Search ..... 75/11, 130.5; 423/53

[56] References Cited

U.S. PATENT DOCUMENTS

| | | | |
|---|---|---|---|
| 2,805,930 | 9/1957 | Udy | 75/11 |
| 2,845,342 | 7/1958 | Udy | 75/11 |
| 2,934,422 | 4/1960 | Udy | 75/11 |
| 2,971,834 | 2/1961 | Backstrom | 75/11 |
| 2,986,459 | 5/1961 | Udy | 75/11 |
| 3,012,875 | 12/1961 | Senior | 75/11 |
| 3,301,669 | 1/1967 | Rathmann | 75/11 |

*Primary Examiner*—Peter D. Rosenberg
*Attorney, Agent, or Firm*—Sughrue, Mion, Zinn, Macpeak, and Seas

[57] ABSTRACT

A process for the production of ferrochromium from iron-containing chromium ores, in which the reduction of the ore, which is mixed with coal and slag-forming constituents, is conducted in a rotary kiln at 1480° to 1580° C. in the presence of a CO-containing atmosphere from 20 to 240 minutes, and in which melting follows in a melting furnace at 1600° to 1700° C. By this process, the greatest part of the gangue of the ore can be separated off before melting the reduced ore.

20 Claims, 1 Drawing Figure

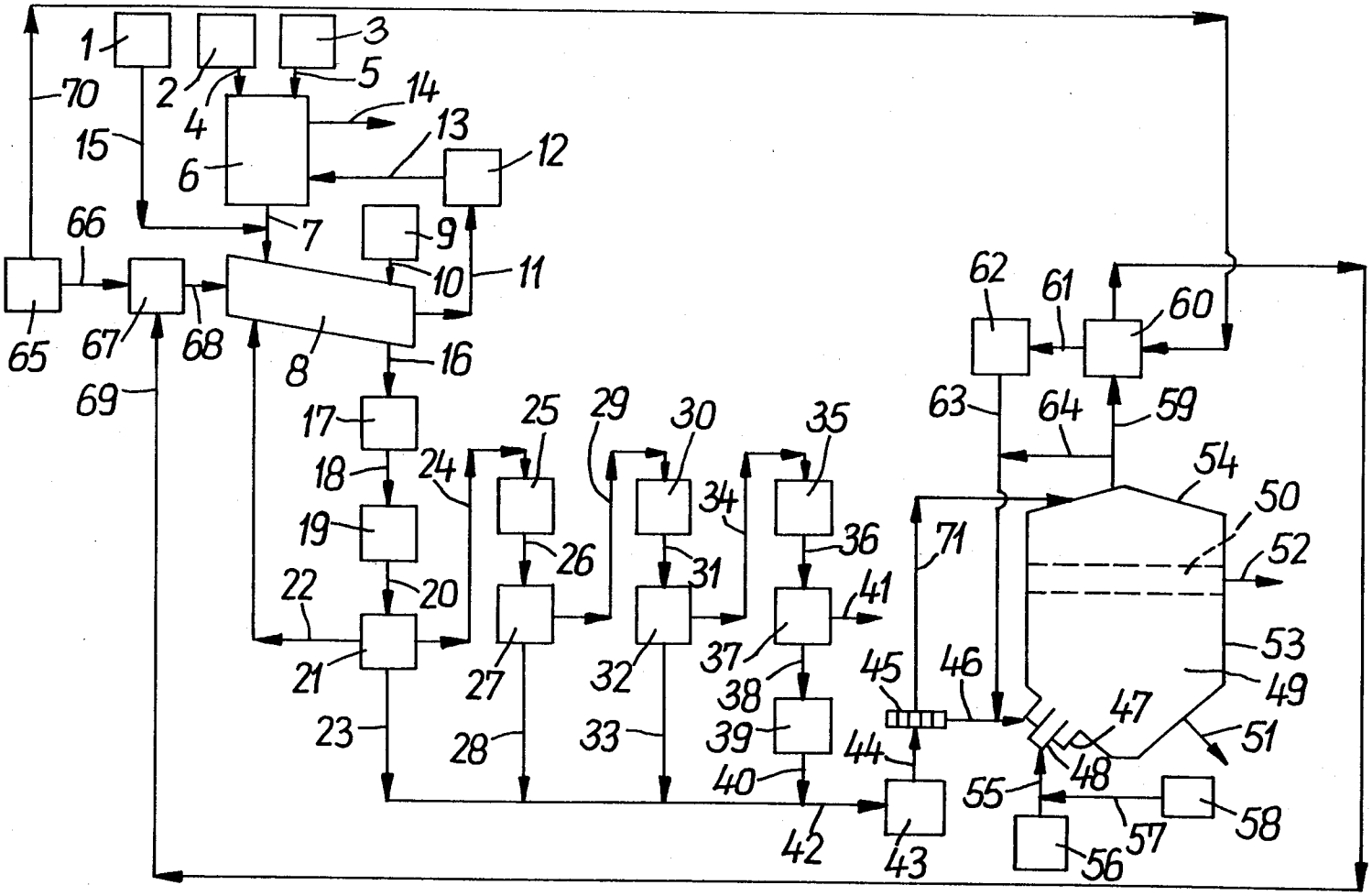
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71

PROCESS FOR THE PRODUCTION OF FERROCHROMIUM

BACKGROUND OF THE INVENTION

The present invention relates to a process for the production of ferrochromium having a carbon content of 0.02 to 10% from iron-containing chromium ore by heating a mixture of chromium ore, solid carbon-containing fuel and slag-forming constituents in a rotary kiln to form a reaction product, and subsequently melting ferrochromium from the reaction product which is removed from the rotary kiln and cooled down before the melting.

Ferrochromium is an alloy which contains or consists of 20 to 70% chromium, 0.02 to 10% carbon, and the rest iron as well as the usual impurities. Ferrochromium is formed through a melting reduction of iron-containing chromium ores, especially chromium iron ore, with coal according to the equation $$FeCr_2O_4+4C=Fe+2Cr+4CO.$$

The melting-reduction is conducted either with a lumpy ore-coke mixture or with ore-pellets and coke or with pre-reduced ore-fine coke-pellets and coke, particularly in a submerged arc furnace, whereby alloys with different carbon content result. Ferrochromium is used for the production of chromium steels as a pre-alloy. The very often undesired high carbon content of the ferrochromium alloys can be reduced through refining of the alloys or through refining of the chromium steel produced from them. Chromium ores generally contain or consist of 20 to 50% $Cr_2O_3$, 10 to 40% FeO and 10 to 70% gangue. It is difficult to even partially separate the gangue before melting the ore, so that a high portion of gangue in the known melt-reduction process must be separated as liquid slag from the produced ferrochromium alloys. Since during this process, considerable portions of $Cr_2O_3$ are still present in the reduction material along with the high melting gangue of the ore, the resulting slags have a high melting point, and melting temperatures of over 1750° C. must be used, despite the addition of flux, in order to largely reduce the chromium oxide out of the liquid slag and to hold the chromium loss at low slag viscosity as low as possible. The high temperatures required for the melt-reduction necessitate an undesirably high use of energy.

A process for the production of carbon-poor ferrochromium is known from German Auglegeschrift NO. 2,062,641, by which a mixture of chromium ore and lime is burned in a cylindrical rotary kiln at more than 900° C., preferably at 1100° C. Then, 30 to 60% of this mixture is melted in an electric furnace into a synthetic slag. To this slag, there is subsequently added 70 to 40% of the burned mixture, more than 80% of the theoretically required amount of silicochromium in the melted state, and up to 20% of the required silicochromium amount in the solid state. This process has the disadvantage that the silicon content of silicochromium must be used as a reduction agent (44% Si, 36.5% Cr), and the entire gangue of the chromium ore is melted in an arc furnace and in the reaction pans.

German Auslegeschrift No. 1,014,137 discloses a process for the melting of iron-poor ore in a cylindrical rotary kiln, in which the pulverized ore is mixed with fuel and is heated to temperatures from 1100° to 1300° C., wherein the ore is reduced to metallic iron and magnetic iron oxide compounds, and in which subsequently the magnetic compounds of the reaction product are separated from the gangue by magnetic separation. Neither German Auslegeschrift No. 2,062,641, nor German Auslegeschrift No. 1,014,137 teach how a separation of the gangue can be achieved before melting the ferrochromium without causing work stoppages in the rotary kiln and without requiring reduction in the melting furnace.

SUMMARY OF THE INVENTION

A primary object of the present invention is to provide a process for the production of ferrochromium, which enables the reduction- and melting-processes to be conducted at low temperatures using carbon as the reduction agent and as supplier of the melt heat.

In particular, it is an object of the present invention to provide a melting process which is able to work at a temperature below 1750° C., and to provide a process in which there is a separation of the predominant part of the gangue of the ore before the melting of the ore reduced with carbon without melting the gangue.

A further object of the present invention is to provide such a process in which the raw materials, namely, chromium ore, coal and slag-forming constituents, can be added without an expensive pre-treatment, and in which a reoxidation of the reduced ore is prevented.

To achieve the foregoing objects and in accordance with its purpose, the present invention provides a process for the production of ferrochromium with a carbon content of from 0.02 to 10% from iron-containing chromium ore by heating a mixture of chromium ore, solid carbon-containing fuel and slag-forming constituents in a rotary kiln, and subsequently melting ferrochromium from the reaction product that is removed from the rotary kiln and cooled down, comprising: (a) forming a mixture of chromium ore, coal and slag-forming constituents, in which the ore-coal ratio is from 1:0.4 to 1:2, the slag-forming constituents originated from the ore and coal such as CaO, MgO, $Al_2O_3$ and $SiO_2$, with separate slag-forming constituents CaO, and/or MgO, $Al_2O_3$ and/or $SiO_2$ being added to the mixture if necessary in such a quantity, that in the final slag including the constituents of the ore and coal and the added fluxes a $(CaO+MgO)/(Al_2O_3+SiO_2)$ ratio exists of from 1:1.4 to 1:10, and the $Al_2O_3/SiO_2$ ratio amounts to 1:0.5 to 1:5; (b) heating the mixture in the rotary kiln from 20 to 240 minutes in a CO-containing atmosphere at temperatures of from 1480° to 1580° C. to form a reaction product and removing the reaction product from the rotary kiln; (c) crushing the reaction product removed from the rotary kiln to a particular diameter of less than 25 mm; (d) separating the crushed reaction product by density separation and/or magnetic separation into a coal-containing fraction which is reintroduced into the rotary kiln, at least one metal-containing slag-rich fraction and an alloy fraction to be delivered to a melting furnace; and (e) melting the alloy fraction in a melting furnace at temperatures of from 1600° to 1700° C.

Surprisingly, it has been found that in the process of the present invention carried out in a rotary kiln, which can be a rotary kiln or a rotary drum kiln, a reduction degree of 90 to 98% with respect to chromium and iron is achieved, when the mixture of chromium ore, coal and slag-forming constituents is transformed during the reduction into a plastic state wherein an agglomeration of single metallic particles and small metallic droplets take place. A noticeable reoxidation of the metal particles does not occur, because the metal droplets imbedded in the reduction material, unlike those in the known direct reduction processes in which the original structure of the ore is maintained, have a comparatively small surface. The reaction product leaving the rotary furnace contains very low chromium oxide portions, so that no final reduction is required during melting.

It is also surprising that during the reduction, no chromium carbide is formed, but rather that a ferrochromium alloy is formed. The melting of the reduced material of the rotary kiln can therefore be conducted at temperatures between 600° C., and 700° C. The melting of the reaction product, which is taken from the rotary kiln, occurs in a suitable melting furnace after cooling and separating from the reaction product the rest of the coal and part of the gangue. In this way, by the use in the ore-coal-slag-forming constituents mixtures of a ore-coal ratio of 1:0.4 to 1:2, an optimum reduction process is achieved in the rotary kiln and an optimum melting process is achieved in the melt furnace. The raw material mixture in the rotary kiln is transformed especially quickly into the plastic state, when in the slag the ration of $(caO+MgO)/Al_2O_3+SiO_2)$ and the $Al_2O_3/SiO_2$ ratio of the present invention is used. By crushing of the reaction product taken out of the rotary kiln to a particle diameter of less than 25 mm, it is possible to advantageously separate the largest part of the coal and part of the gangue contained in the discharged material. By the separation of the crushed reaction product according to the invention into several fractions, a way is shown to gain for the subsequent melting operation a fraction which is rich in a ferrochromium alloy and to separate coal and part of the gangue. The CaO, MgO, $Al_2O_3$ and $SiO_2$ content of the chromium ore as well as the ashes of the coal should be considered for proportioning the amount of the slag-forming constituents.

BRIEF DESCRIPTION OF THE DRAWING

The sole FIGURE of the drawing shows a flow chart of a preferred embodiment of the process of the invention.

DETAILED DESCRIPTION OF THE INVENTION

In a preferred embodiment of the present invention, before carrying out process step (a), the mixture of chromium ore, coal and slag-forming constituents is subjected to a first pre-reduction treatment and then a second pre-reduction treatment by heating the mixture in a rotary kiln in a CO-containing atmosphere for a period of 30 to 90 minutes at a temperature of 1100° to 1250° C. and then for a period of 30 to 90 minutes at a temperature of 1400° to 1480° C. Because the reduction of the chromium oxide first occurs on a significant scale at temperatures above 1200° C., the iron oxides contained in the chromium ore are selectively and substantially reduced through the first pre-reduction step at 1100° to 1250° C. The iron resulting thereby has already formed small liquid droplets and absorbs carbon and silicon that develop through reduction of a part of the $SiO_2$ contained in the mixture. The metallic phase formed in the first pre-reduction step contains iron as the chief constituent as well as up to 19% silicon, as has been shown in an analysis conducted with a microprobe. With the second pre-reduction step conducted at 1400° to 1480° C., the droplets formed in the first pre-reduction step enlarge and absorb chromium formed at 1400° to 1480° C. through reduction. The two pre-reduction steps, which are carried out before the actual reduction step, work together, so that the formation of high melting chromium carbide is excluded and the ferrochromium exists in the reduction product of the rotary kiln in the form of coarse particles, through which the subsequent preparation of the reaction product is simplified. Moreover, the reduction according to process step (b) takes place in a comparatively short time when the two pre-reduction steps are carried out.

The process according to the present invention can be especially successfully carried out, when the mixture of chromium ore, coal and slag-forming constituents is heated in the rotary kiln for a period of 20 to 120 minutes at temperatures of 1510° to 1560° C., whereby in the slag a $(CaO+MgO)/(Al_2O_3+SiO_2)$ ratio of 1:3 to 1:5.5 exists and the $Al_2O_3/SiO_2$ ratio amounts to 1:0.8 to 1:2.5.

Preferably, according to the present invention, in the chromium ore-coal-slag-forming constituents mixture, the chromium ore has a particle diameter under 5 mm, the coal a particle diameter under 15 mm, and the separately added slag-forming constituents a particle diameter under 5 mm. With a composition of the raw material mixture of this kind, it is not necessary to granulate or to pelletize the raw materials before their introduction into the rotary kiln, because by charging the raw materials with the particle sizes according to the present invention, surprisingly no disturbance in the rotary kiln is observed during the reduction process. Of course, it is also possible to charge the rotary kiln with a granulated or pelletized raw material mixture. It is also preferred, according to the present invention, that $SiO_2$ is only added to the chromium ore-coal-slag-forming constituents mixture in the rotary kiln when the mixture has a temperature of more than 1200° C. By so doing, the formation of low melting slag components of FeO, $SiO_2$, especially fayalite, is advantageously avoided.

According to the present invention, it is especially advantageous when the reaction product taken out of the rotary kiln is cooled down at a rate of less than 700° C./h to a temperature below the Curie temperature of ferrochromium, because then the throughput takes on ferromagnetic characteristics, and it can thus be supplied in an advantageous manner to a magnetic separation.

In a further preferred embodiment of the present invention, each metal-containing slag-rich fraction is crushed to a particle diameter of less than 5 mm, and is separated by density separation and/or magnetic separation into a metal-poor slag and an alloy fraction to be delivered into the melting furnace. This preparation step raises the yield of the ferrochromium alloy produced.

Additionally, in a further preferred embodiment of the present invention, each metal poor slag fraction is ground to a particle diameter of less than 0.5 mm, and is separated by density separation and/or magnetic separation into a slag fraction and an alloy fraction to be delivered into the melting furnace. Also, the yield of the ferrochromium produced is increased even more by this preparation step. Finally, it is advantageous according to the present invention, to pulverize the slag fraction to a particle diameter of less than 0.2 mm, and then separate it through flotation into a metal-free slag fraction and an alloy fraction to be delivered to the melting furnace, wherein the alloy fraction is dried before the melting. By the flotation preparation, the last metal remainder can be obtained from the slag fraction.

It is preferred according to the present invention that the portion of the alloy fraction with a particle diameter under 1 mm is blown into the melt in the melting furnace. The injection can occur either from above or below the metal bath surface. Uniform melt-down is achieved by the injection of a portion of the alloy fraction into the melt. The portion of the alloy fraction with a diameter above 1 mm is charged from above in the melting furnace.

According to the present invention, it is especially advantageous when the portion of the alloy fraction with a particle diameter under 1 mm, as well as coal with a particle diameter under 1 mm, are suspended in a carrier gas and are blown into the melt through a first nozzle provided in the melting furnace underneath the metal bath surface, while oxygen is introduced into the melt through a second nozzle coordinated with the first nozzle. By the common injection of these materials, uniform melt-down is achieved with the optimum intermixture of the melt and the slag.

In a further embodiment of the present invention, the alloy fraction-coal-carrier gas suspension is blown into the melt through the outer tube of a jacket nozzle arranged underneath the metal bath surface in the melting furnace, and oxygen is blown into the melt through the inner tube of the nozzle. The jacket nozzle has been especially successful for introducing the different materials into the melting furnace.

In a further embodiment of the present invention, 0.4 to 1.0 kg coal, and a stoichiometric quantity of oxygen corresponding to the quantity of coal (obtained with respect to the oxidation product CO) are blown into the melt underneath the metal bath surface. At these ratios, a sufficiently large amount of melting heat is produced in the melting furnace, whereby an overly large coal content is prevented in the melt. The economy of the process according to the present invention is increased, by using at least a portion of the exhaust gas of the melting furnace as a carrier gas for the portion of the alloy fraction as well as for the fine-grained coal, which are blown into the melt. However, other inert gases, particularly nitrogen, can also be used as a carrier gas.

According to the present invention, it is preferred that the heat of the exhaust gases from the melting furnace will be used for the carbonization of coal that is blown into the melt under the surface of the metal bath. By this means, the volatile components contained in the coal are driven off, so that a low-temperature coke is produced. The low-temperature coke, compared with the uncarbonized coal, has a greater usable heat content, which is advantageous for the progress of the melting process. For the energy balance of the process according to the present invention, it has proved to be particularly advantageous, if the exhaust gas from the melting furnace that is not used as a carrier gas and the carbonization gas produced from the carbonization of the coal are burned in the rotary kiln. According to the present invention, it has also been demonstrated to be advantageous if the exhaust gas from the rotary kiln is afterburned, and at least part of the heat content of the afterburned exhaust is used to preheat the ore and the slag-forming constituents. The reduction time according to the present invention does not include the preheating time.

In a further embodiment of the present invention, the melt is refined batch wise by the injection of oxygen as well as desulfurized by the addition of CaO and/or $CaC_2$. The refining and desulfurizing can take place either in the melting furnace itself or in an auxiliary second melting vessel. The CaO or $CaC_2$, respectively, can be suspended in a nitrogen stream that is blown into the melt through the inner tube of the nozzle. Through refining and desulfurizing, the carbon content can be reduced to 0.02% and the sulfur content can be reduced to 0.01%. During the refining, the temperature of the melt increases to more than 1700° C.

Finally, it is preferred according to the present invention that the melted slag obtained in the melting furnace is cooled, pulverized and mixed with the metal-containing slag-rich fraction. By this means, it is advantageously achieved that the metal portions present in the melted slag can be recovered.

Referring now to the drawing, which illustrates a typical flow chart of the process according to the present invention, there is shown a bin 2 which contains iron-containing chromium ore that has a particle size of <5 mm. The ore in bin 2 is conveyed into a countercurrent heat exchanger 6 through a pipe 4. Slag-forming constituents CaO, MgO and $Al_2O_3$ that have a particle size of <5 mm are conveyed from a bin 3 through a pipe 5 into countercurrent heat exchanger 6. In countercurrent heat exchanger 6, the ore-slag-forming constituents mixture is preheated to temperatures up to 1000° C. Countercurrent heat exchanger 6 is operated with hot exhaust gases which are conducted into countercurrent heat exchanger 6 through a pipe 13. The cooled-down gases are drawn off from countercurrent heat exchanger 6 through a pipe 14 and released into the atmosphere after dust removal (not shown in the drawing). The preheated raw materials in countercurrent heat exchanger 6 are conveyed to a cylindrical rotary kiln 8 through a pipe 7. Moreover, coal that has a particle size of <15 mm is delivered from a bin 1 to cylindrical rotary kiln 8 through a pipe 15.

Cylindrical rotary kiln 8 is heated by burning fine-grained coal that is delivered from a bin 65 through a pipe 66 to a burner 67, and from there through a pipe 68 into cylindrical rotary kiln 8. Cylindrical rotary kiln 8 is preferably heated in countercurrent to the preheated raw materials and the coal; this can, however, also take place in co-current flow, as is illustrated in the drawing. The pre-heated raw materials delivered into cylindrical rotary kiln 8 and the coal are first heated to a temperature of 1100° to 1250° C. and remain at this temperature about 45 minutes in the first kiln zone, where the first pre-reduction step occurs, in which the iron oxide is selectively and substantially reduced. The mixture then moves under additional heat supply into a second kiln zone, in which it is held at 1400° to 1480° C. for about 45 minutes, whereby the metal droplets are enlarged. In the third kiln zone of the cylindrical rotary kiln 8, a temperature of 1510° to 1560° C. is preferably maintained. The reduction product is held at these conditions for about 60 minutes and thereby assumes a plastic state, in which larger metal droplets are formed and several particles of the reduction material agglomerate. Certainly, in cylindrical rotary kiln 8, no separation of the metallic phase and the gangue occurs, and the plastic condition of the reduction material does not lead to baking on in cylindrical rotary kiln 8. The baking on can, in particular, be prevented by providing the cylindrical rotary kiln with a magnesite lining that contains additions of chromium oxide and/or coal and/or tar.

In the zone of rotary kiln 8, in which the reduction material has a temperature of more than 1200° C., $SiO_2$, required for slag formation, which has a particle size of <5 mm, is introduced from a bin 9 through a pipe 10.

In the cylindrical rotary kiln 8, with regard to the $SiO_2$ content of coal from bin 9, only so much $SiO_2$ is introduced as is necessary to produce a plastic condition. The CO-containing exhaust gas is conducted from cylindrical rotary kiln 8 through a pipe 11 to a combustion chamber 12, where it is afterburned.

The discharge from the rotary kiln 8 arrives through a pipe 16 into a cooling drum 17, where it is cooled off at a rate of <700° C./h to a temperature below the Curie temperature of the ferrochromium alloy. Through this cooling, the ferrochromium alloy obtains ferromagnetic characteristics. The cooled throughput of cylindrical rotary kiln 8 then arrives through a pipe 18 into a crusher 19, where a pulverization to a particle diameter of <25 mm results. Subsequently, the pulverized throughput of cylindrical rotary kiln 8 is delivered through a pipe 20 into a magnetic separator 21, in which a separation of the throughput into a nonmagnetic coal-containing fraction, a metal-containing slag-rich fraction, and a metal-rich alloy fraction occurs. The coal-containing fraction is conducted through a pipe 22 into cylindrical rotary kiln 8, while the metal-rich alloy fraction is conducted to a bin 43 through pipes 23 and 42.

The metal-containing slag-rich fraction is conducted through a pipe 24 to a grinder 25, where pulverization to a particle diameter of <5 mm occurs. The pulverized material then arrives through a pipe 26 into a pneumatic concentrating table 27, in which the mixture is separated according to its different densities into an alloy fraction and a metal-poor slag fraction. The alloy fraction arrives through pipes 28 and 42 into bin 43, while the metal-poor slag fraction is conducted through a pipe 29 into a grinder 30, where pulverization to a particle diameter of <0.5 mm takes place. Subsequently, the pulverized metal-poor slag fraction from grinder 30 arrives through a pipe 31 into a pneumatic concentrating table 32, where a separation into an alloy fraction and a slag fraction occurs. The alloy fraction is conducted through pipes 33 and 42 into bin 43, while the slag fraction arrives through a pipe 34 into a grinder 45. Pulverization to a particle diameter <0.2 mm is conducted in grinder 35, and the thus-pulverized slag fraction then arrives through a pipe 36 into a flotation device 37, where separation into an alloy fraction and a metal-free slag fraction occurs. The alloy fraction is delivered through a pipe 38 into a dryer 39, while the metal-free slag fraction arrives at a dump through a pipe 41, where it is stored. The alloy fraction is dried in dryer 39 and is then conducted through pipes 40 and 42 into bin 43.

The individual metal containing alloy fractions are mixed in bin 43 and arrive through a pipe 44 at vibrating screen 45, where the grain fraction with a particle diameter of <1 mm is separated. The grain fraction with a particle diameter of >1 mm is introduced into a melting furnace 53 through a pipe 71 and an exhaust gas hood 54. The grain fraction with a particle diameter of <1 mm, on the other hand, comes into melting furnace 53 through a pipe 46 and the outer tube 47 of a jacket nozzle. In melting furnace 53 is the melt 49 comprised of the ferrochromium alloy, which is removed from melting furnace 53 in portions at given intervals through an outlet 51. A slag 50 floats on melt 49, and is removed at given intervals from melting furnace 53 through an outlet 52. The exhaust gas of melting furnace 53 accumulated in exhaust gas hood 54 is used in part as carrier gas and is reintroduced into the melt 49 through pipes 64, 63 and 46 as well as through outer tube 47 of the jacket nozzle. Through the inner tube 48 of the cap jet, oxygen from a storage tank 56 is blown through a pipe 55 into melt 49, to which CaO can be added through a pipe 57, which is contained in a storage vessel 58 and has a particle size of <1 mm.

A portion of the exhaust gas from melting furnace 53 arrives through a pipe 59 into a carbonization apparatus 60, to which coal with a particle size of <1 mm from bin 65 is delivered through a pipe 70. The carbonization gas and the exhaust gas from melting furnace 53 leave carbonization apparatus 60 through a pipe 69 and are subsequently burned in burner 67. The low-temperature coke leaves carbonization apparatus 60 through a pipe 61 and is stored in a bin 62. From there, the low-temperature coke is suspended in the carrier gas passing through pipe 64, and through pipes 63 and 46 together with the alloy fraction is blown into the metal melt 49, where the melting process proceeds.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE

To produce a ferrochromium alloy, an iron-containing chromium ore with the following composition is used: 46% $Cr_2O_3$, 28.2% FeO, 10% MgO, 1.1% $SiO_2$, 14.2% $Al_2O_3$ and 0.5% CaO. The ore is pulverized to a particle diameter of <2 mm. The water-free coal used for reduction has the following composition: 18.8% ash, 73.6% carbon, 3.2% hydrogen, 1.5% nitrogen. The coal is pulverized to a particle size of <15 mm. The ash of the coal used contains the following major components: 52% $SiO_2$, 30% $Al_2O_3$, 5% CaO and 2% MgO. A rotary drum furnace is charged with 350 kg of pulverized ore and 350% of pulverized coal. The ore-coal ratio thus amounts to 1:1.

The rotary drum furnace has a lining of chromium magnesite and is preheated before charging with the ore-coal mixture to a temperature of 1600° C. A coal dust-oxygen burner is used to heat the furnace, which is operated with 4 kg of fine coal per minute and 3 $Nm^3$ of oxygen per minute. In addition, air is introduced into the furnace, so that the exhaust gas from the rotary drum furnace contains 25 vol.% $CO_2$ and 12 vol.% CO. The ore-coal mixture remains 70 minutes at 1540° C. in the rotary drum furnace. In the present case, it is not necessary to introduce slag-forming constituents in the rotary drum furnace because of the composition of the ore and the coal.

The throughput of the rotary furnace is discharged into a vessel, covered with coal and cooled for 4 hours to 100° C. The throughput contains 45% particles with a particle diameter >20 mm and 50% particles with a particle size <10 mm. Visible spherical metal particles are firmly embedded in the throughput. The throughput is subsequently pulverized to a particle diameter of <10 mm, and by magnetic separation is separated into a metal-containing fraction (60%) and a coal-containing fraction (40%). The metal-containing fraction consists to about ⅓ of particles that have a diameter of <0.3 mm and a metal content of about 80%. This fine-grained portion is separated and is added to the alloy fraction. Afterwards, the remainder of the metal-containing fraction is separated by dry density separation into a metal-poor slag fraction and a metal-rich alloy fraction. The metal-rich alloy fraction consists of up to 90% of the ferrochromium alloy and up to 10% slag. The metal-poor slag fraction still contains a remainder of ferrochromium alloy that must be separated. From the slag fraction with a particle diameter of from 0.3 to 2 mm, after grinding to a particle diameter of <0.1 mm, a metal-rich part-fraction is separated by magnetic separation, which is mixed with the metal-rich alloy fraction. The chromium loss that occurs due to the chromium content of the metal-poor slag collected in the magnetic separation, amounts to about 5%.

The alloy fraction is melted in a crucible that has a capacity of 3 tons and in which is contained 1200 kg of a metal bath having a temperature of about 1650° C. Through the outer tubes of the three jacket nozzles provided in the bottom of the crucible, 8 kg of fine coal per minute are blown into the metal into the melt. Through the inner tubes of the three cap jets, 6 $Nm^3$ of oxygen per minute are introduced into the melt. In the molten metal, a carbon content of from 3 to 6 weight-% is maintained. The fine-grained portion of the metal-rich alloy fraction with a particle size of <0.5 mm is blown into the melt together with the coal, while the remainder of the metal-rich alloy fraction is charged in the crucible through the exhaust gas hood. The slag in the crucible has a $(CaO+MgO)/(SiO_2+Al_2O_3)$ ratio of 1:2.5 and an $Al_2O_3$-$SiO_2$ ratio of 1:1. The slag is in a fluid state at melting temperature and is drawn off after melting 1000 kg of metal.

After removal of the slag, the addition of coal into the melt is reduced to 4 kg per minute and the temperature of the metal bath is raised to 1750° C. With this procedure, the carbon content of the melt is reduced to about 2 weight %. Subsequently, 8 kg of CaO per minute that is suspended in nitrogen is blown through the inner tube of the three tubes of the jacket nozzles. By this means, the sulfur content of the melt is reduced to a value of <0.01%. The metal removed from the crucible has a composition of 56% chromium, 42% iron and 2% carbon.

Into the exhaust gas from the crucible are blown in 8 kg per minute of fine coal. The exhaust gas is thus cooled to 600° to 700° C., and the volatile components of the coal are expelled. The gas mixture of the carbonization gas and the cooled exhaust gas from the melting vessel is burned. The low-temperature coke obtained in the carbonization is ground and blown into the vessel through the outer tubes of the jacket nozzles.

The iron and chromium yield that was reached carrying out the procedure according to the example, is about 93%. The process conditions of the example diverge insignificantly from those of the process flow chart because the example was carried out on a comparatively small scale.

In density separation, a mixture consisting of solid particles of differing densities with a narrow grain fraction are suspended in a liquid or gas flow, and out of this suspension particles having the same density fall out in about the same place. In flotation, a mixture containing solid particles of differing wettability are suspended in a liquid and air is blown into this suspension, whereby the particles with low wettability are carried away by the air flow and separated from the particles with high wettability. In magnetic separation, ferromagnetic particles are separated through the force of a magnetic field. All percentages stating the composition of materials and indicated by the symbol "%", are weight percentages. The ratios which describe the composition of mixtures of materials are weight ratios.

It will be understood that the above description of the present invention is susceptible to various modifications, changes and adaptations, and the same are intended to be comprehended within the meaning and range of equivalents of the appended claims.

What is claimed is:

1. Process for the production of ferrochromium with a carbon content of from 0.02 to 10 weight % from iron-containing chromium ore by heating a mixture of chromium ore, solid carbon-containing fuel and slag-forming constituents in a rotary kiln and subsequently melting ferrochromium from the reaction product that is removed from the rotary kiln and cooled down, comprising:

(a) forming a mixture of chromium ore, coal and slag-forming constituents, in which the ore-coal ratio is from 1:0.4 to 1:2, the slag-forming constituents being CaO, MgO, $Al_2O_3$ and $SiO_2$, and originating from the ore and coal and if necessary being added as flux in the form of at least one separate slag-forming constituent of CaO, MgO, $Al_2O_3$, or $SiO_2$ in such a quantity, that in the final slag including the constituents of the ore and coal and the added fluxes a $(CaO+MgO)/Al_2O_3+SiO_2)$ ratio exists of from 1:1.4 to 1:10, and the $Al_2O_3/SiO_2$ ratio amounts to 1:0.5 to 1:5;

(b) heating the mixture in the rotary kiln from 20 to 240 minutes in a CO-containing atmosphere at temperatures of from 1480° to 1580° C. to form a reaction product and removing the reaction product from the rotary kiln;

(c) crushing the reaction product removed from the rotary kiln to a particle size of less than 25 mm;

(d) separating the crushed reaction product by density separation and/or magnetic separation into a coal-containing fraction which is reintroduced into the rotary kiln, at least one metal-containing slag-rich fraction and an alloy fraction to be delivered to a melting furnace; and (e) melting the alloy fraction in a melting furnace at temperatures of from 1600° to 1700° C.

2. Process according to claim 1, wherein the mixture of chromium ore, coal and slag-forming constituents, before conducting process step (a), is heated in the rotary kiln in a CO-containing atmosphere first for a period of 30 to 90 minutes at a temperature of 1100° to 1250° C. and then is heated for a period of from 30 to 90 minutes at a temperature of from 1400° to 1480° C.

3. Process according to claim 1, wherein the mixture of chromium ore, coal and slag-forming constituents is heated in a rotary kiln for a period of 20 to 120 minutes at temperatures of 1510° to 1560° C., wherein the $(CaO+MgO)/(Al_2O_3/SiO_2)$ ratio in the slag is from 1:3 to 1:5.5 and the $Al_2O_3/SiO_2$ ratio amounts to 1:0.8 to 1:2.5.

4. Process according to claim 1, wherein, in the chromium ore-coal-slag-forming constituents mixture, the chromium ore has a particle diameter of under 5 mm, the coal has a particle diameter of under 15 mm, and the slag-forming constituents have a particle diameter of under 5 mm.

5. Process according to claim 1, wherein $SiO_2$ is only added to the chromium ore-coal-slag-forming constituents mixture in the rotary kiln when the mixture has a temperature of more than 1200° C.

6. Process according to claim 1, wherein the reaction product taken out of the rotary kiln is cooled off at a rate of less than 700° C. per hour to a temperature under the Curie temperature of ferrochromium.

7. Process according to claim 1, wherein each metal-containing slag-rich fraction is crushed to a particle diameter of less than 5 mm and is separated by density separation and/or magnetic separation into a metal-poor slag fraction and an alloy fraction to be delivered to the melting furnace.

8. Process according to claim 7, wherein each metal-poor slag fraction is ground to a particle diameter of less than 0.5 mm and is separated by density separation and/or magnetic separation into a slag fraction and an alloy fraction to be delivered to the melting furnace.

9. Process according to claim 8, wherein the slag fraction is crushed to a particle diameter of less than 0.2 mm and is separated by flotation into a metal-free slag fraction and an alloy fraction to be delivered into the melting furnace, wherein the alloy fraction is dried before melting.

10. Process according to claim 1, wherein the alloy fraction has a portion with a particle diameter of less than 1 mm, and this portion is blown into the melt contained in the melting furnace.

11. Process according to claim 10, wherein the portion of the alloy fraction with a particle diameter of less than 1 mm, as well as coal with a particle diameter of less than 1 mm, are suspended in a carrier gas and blown into the melt through a first nozzle provided in the melting furnace under the metal bath surface, while oxygen is introduced into the melt through a second nozzle coordinated with the first nozzle.

12. Process according to claim 11, wherein the alloy fraction-coal-carrier gas suspension is blown into the melt through the first nozzle which is in the form of an outer tube of a jacket nozzle provided in the melting furnace under the surface of the metal bath, and the oxygen is blown into the melt through the second nozzle which is in the form of an inner tube of the jacket nozzle.

13. Process according to claim 11, wherein from 0.4 to 1.0 kg of coal and a stoichiometric quantity of oxygen corresponding to the quantity of coal is blown into the melt under the metal bath surface per kilogram of alloy fraction introduced into the melting furnace.

14. Process according to claim 11, wherein at least a part of the exhaust gas of the melting furnace is used as a carrier gas.

15. Process according to claim 14, wherein the heat of the exhaust gas from the melting furnace is used to carbonize the coal that is blown into the melt beneath the metal bath surface.

16. Process according to claim 15, wherein the exhaust gas of the melting furnace not used as carrier gas and the carbonization gas produced from the carbonization of the coal are burned in the rotary kiln.

17. Process according to claim 1, wherein the exhaust gas of the rotary kiln is afterburned and the heat content of the afterburned exhaust gas is used at least partially to preheat the chromiun ore and the slag-forming constituents.

18. Process according to claim 1, wherein the melt is batch wise refined by blowing in oxygen as well as disulfurized by the introduction of CaO and/or $CaC_2$.

19. Process according to claim 1, wherein a melted slag is obtained in the melt furnace and is cooled, crushed and mixed with the metal-containing slag-rich fraction.

20. Process according to claim 1, comprising heating in step (a) to reduce the chromium and iron to a degree of 90 to 98%.

* * * * *